United States Patent [19]

t'Kint de Roodenbeke

[11] 4,290,230

[45] Sep. 22, 1981

[54] GATE FOR SUPERMARKETS AND SIMILAR ESTABLISHMENTS

[75] Inventor: Amaury H. t'Kint de Roodenbeke, Brussels, Belgium

[73] Assignee: Technical Services, Société Anonyme, Brussels, Belgium

[21] Appl. No.: 112,271

[22] Filed: Jan. 15, 1980

[30] Foreign Application Priority Data

Jan. 22, 1979 [EP] European Pat. Off. ..... 79200038.2

[51] Int. Cl.[3] ..... E01F 13/00

[52] U.S. Cl. ..... 49/49; 49/141

[58] Field of Search ..... 49/141, 140, 25, 44, 49/49, 184, 383; 16/140, 141, 143

[56] References Cited

U.S. PATENT DOCUMENTS 1,965,449 7/1934 Blanchard ..... 49/44

4,101,235 7/1978 Nelson ..... 49/49 X

FOREIGN PATENT DOCUMENTS 1424330 2/1976 United Kingdom ..... 49/49

*Primary Examiner*—Kenneth Downey

*Attorney, Agent, or Firm*—Bacon & Thomas

[57] ABSTRACT

The invention pertains to a gate of the type generally used in the supermarkets and similar establishments, comprising substantially the combination of at least a bracket including an electric motor driving a vertical shaft carrying a barrier consisting preferably of a U-shaped cross-bar, the said electric motor being operated through signals coming from a passage detecting system, characterized in that the free ends of the said barrier are pivotably and adjustably connected with supporting levers secured to the said vertical shaft, the axis of the said shaft being spaced from the vertical limiting plane of the passage by a distance which is at least equal to the thickness of the barrier of the gate, windows being provided in the bracket, thereby allowing a rotation of the said barrier of at least 90° from a position perpendicular to the said limiting plane to a position parallel with the latter and vice versa.

2 Claims, 5 Drawing Figures

GATE FOR SUPERMARKETS AND SIMILAR ESTABLISHMENTS

This invention relates to a gate of the type generally used in supermarkets or similar so-called large surface establishments.

As a principle, the gates of the above-mentioned type comprise substantially at least a bracket including an electric motor actuating a vertical shaft carrying a barrier consisting preferably of a U-shaped cross-bar. The electric motor is operated by signals coming from a well-known passage detecting system. This assembly is designed so that when a person passes through the said detecting system, the latter operates the electric motor which, in turn, pivots the said barrier on a quarter of turn relative to the said bracket, thereby clearing the passage. However, the known gates used heretofore are relatively criticizable owing to the safety and the comfortable passage of the users.

Thus, the bar forming the barrier of the gate is generally made of a single part, the free ends thereof being connected with the vertical shaft operated by the said electric motor. The said free ends of the bar are bent at right angles and are at least partially embedded within the said bracket through rectangular windows provided laterally in the wall of the bracket in front of the passage.

When the gate is in closed position, the bent ends of the bar are completely embedded within the bracket whereas, in opened position, the same parts are projecting through side rectangular windows formed in the wall of the bracket, the bar itself being directed in a direction parallel with the passage. It is apparent that the width of the passage is thereby reduced by a value corresponding to the thickness of the barrier so that the users are likely to get caught on the said projecting bent ends of the bar, thereby damaging their packages and clothes.

It is known that the supermarkets and similar establishments must comply to very strict national laws relative to the safety of the customers and the staff, e.g. in case of fire. Thus, the government set a minimum relation to be met between the area of the shop and the total width of the available exits.

As a principle, the known gates are designed to be only opened automatically in only one direction. However, according to the law, said gates must be provided with a system allowing them to be manually opened in a reverse direction, thereby allowing a rapid escape out of the shop when a danger occurs.

Owing to their above described construction, the known gates have a drawback in that they cannot offer a sufficiently large and easy passage in a reverse direction to allow a rapid escape out of the establishments.

In consideration of the above-mentioned reasons, it is an object of the present invention to provide an improved gate allowing not only to make the conventional passage larger and easier, but presenting also the advantage of a maximum utilization of the total width of the available passage zones to provide for a rapid escape out of the establishment.

A gate according to the invention comprises substantially at least a bracket including an electric motor driving a vertical shaft carrying a barrier consisting preferably of a U-shaped cross-bar, the said electric motor being controlled through signals coming from a known passage detecting system and it is characterized in that the free ends of the said bar are pivotably and adjustably connected with the supporting levers secured to the said driving shaft, the axis of latter being separated from the vertical limiting plane of the passage by a distance at least equal to the thickness of the barrier of the gate, windows being provided in the bracket to allow a rotation of the said barrier of at least 90° from a position perpendicular to the said limiting plane to a position parallel with the latter and vice versa.

The vertical limiting plane of the passage is defined as the vertical plane tangential to such end of the bracket which is nearest to the passage, the said passage being itself defined by the distance separating, on the one hand, the said vertical limiting plane from the said bracket and, on the other hand, the said vertical limiting plane from a second bracket, a pillar or a wall.

The object of the present invention will be more readily apparent from the following detailed description of a practical embodiment given without any limitation, reference being made to the enclosed drawings in which.

Figure 1:
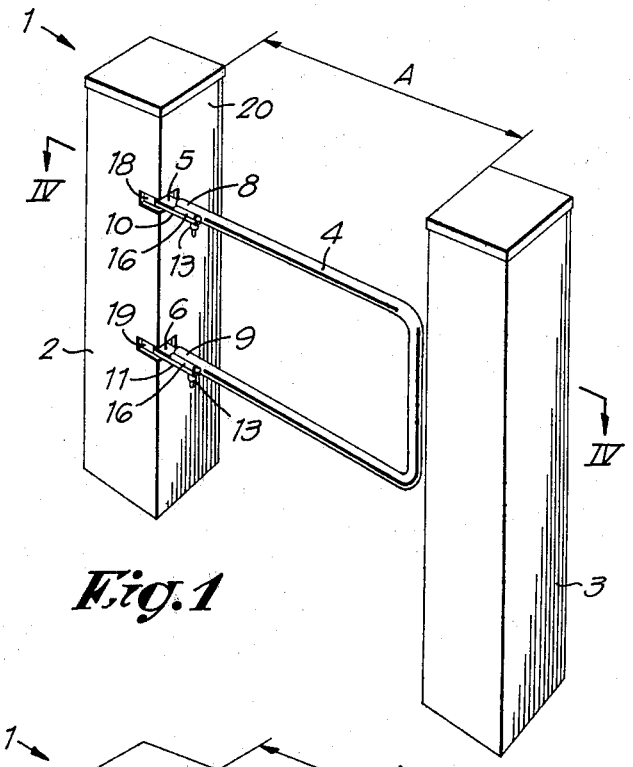
FIG. 1 is a perspective view of a gate according to the invention in closed position.

In FIG. 1, the gate 1 is shown in a closed position, i.e. a position obstructing the passage A defined by the vertical limiting plane of the bracket 2 and the vertical limiting plane of a second bracket, a pillar or a wall 3.

The gate 1 comprises a barrier preferably made of a U-shaped cross-bar 4 supported by the bracket 2 through supporting levers 5, 6. Inside the bracket 2, the supporting levers 5, 6 are secured to a vertical shaft 7 driven by an electric motor (not shown). The electric motor is itself operated by a passage detecting system which is not shown, but well-known.

Figure 5:
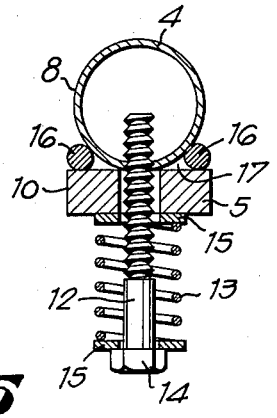
FIG. 5 shows, on an enlarged scale, a section taken on the line V—V of FIG. 2.

The free ends 8 and 9 of the barrier 4 are secured on projecting ends 10, 11 of the supporting levers 5, 6 by means of bolts 12 (FIG. 5). Springs 13 are provided between the heads 14 of the bolts 12 and the lower sides of the supporting levers 5, 6, thereby allowing to adjust the pressure with which the free ends 8, 9 of the barrier 4 are kept against the ends 10, 11 of the supporting levers 5, 6. On either side of the springs 13, are provided washers 15.

The ends 10, 11 of the supporting levers 5, 6 are provided, on their longitudinal edges, with two mutually parallel cylindrical rods 16 welded on the upper sides of the said levers 5, 6 and extending longitudinally thereto. The rods 16 are spaced apart by a distance which is slightly less than the diameter of the bar 4, the diameter of the said rods 16 being substantially less than the latter.

When the gate 1 is in normal closed position (FIG. 1), the free ends 8, 9 of the bar 4 rest in the housings 17 formed by the rods 16 and the upper sides of the levers 5, 6. By this way and under the action of the springs 13, the barrier 4 is normally kept in alignment with the levers 5, 6.

Figure 2:
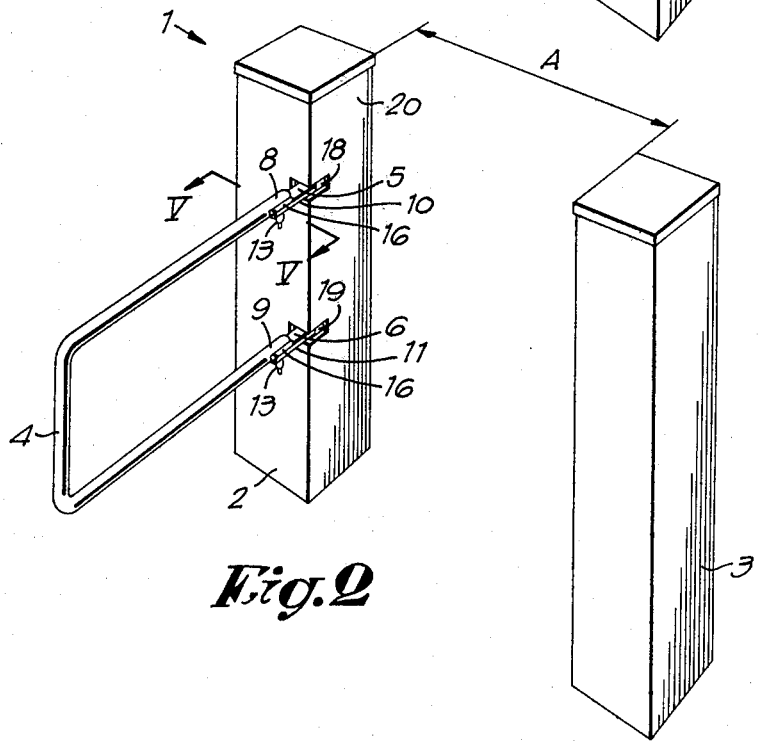
FIG. 2 is a perspective view of a gate according to the invention in the conventional opened position.

When a person passes through the known detecting device (not shown), the latter operates the motor which pivots the vertical shaft 7 and, accordingly, the supporting levers 5, 6, on a quarter of turn. By this way, the barrier 4 is forcibly following this movement to reach the opening operation as shown in FIG. 2.

It should be noted that, according to a particular characteristic of the present invention, the levers 5, 6 may be moved through the rectangular windows 18, 19, thereby clearing completely the passage A, no part of the gate 1 and more particularly of the barrier 4 projecting at the side 20 of the bracket 2 in front of the said passage.

After a delay time necessary to allow the passage of the concerned person, the gate 1 is closed automatically and comes back to the position shown in FIG. 1.

Figure 3:
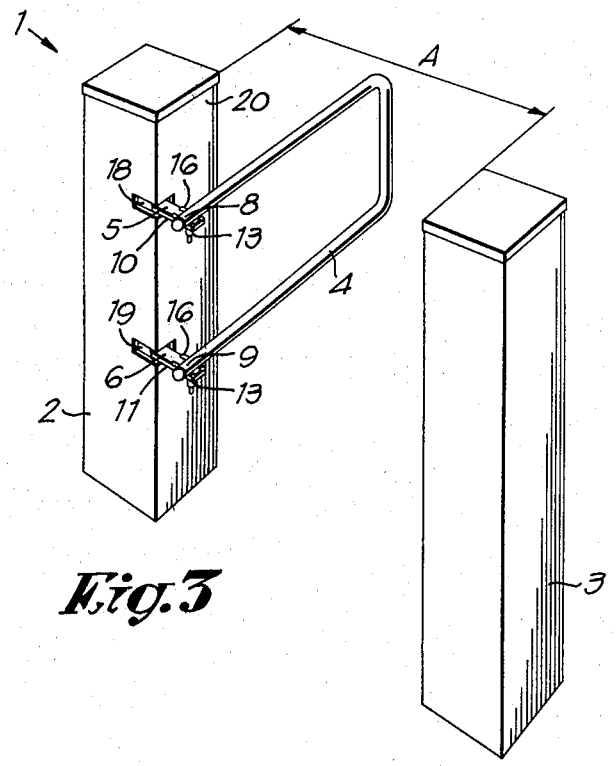
FIG. 3 is a perspective view of a gate according to the invention in a position opened in a reverse direction.

When the gate is in closed position, e.g. in case of fire, the barrier 4 may be pushed manually backwards by exerting a certain minimum force so that the gate 1 comes to the position as shown in FIG. 3. The said minimum force is the force being overcome, on the one hand, to lift the free ends 8, 9 of the barrier 4 from the housings 17 against the action of the springs 13 and, on the other hand, to overcome the friction between the respective parts. It will be noted that an exit passage having a width substantially equal to that of the passage A is thereby available for the people which may thereby escape.

Figure 4:
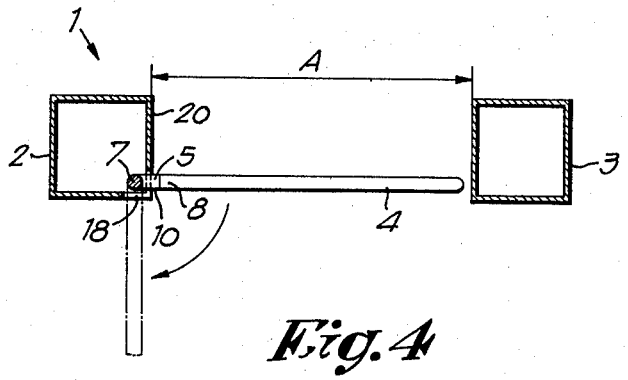
FIG. 4 is a view taken on the line IV—IV of FIG. 1.

It is shown clearly in FIG. 4 that the conventional passage A may be used on its whole width whereas, in the known gates, the width of the passage A is always reduced by a value corresponding to the thickness of the barrier. In fact, in opened position, the known gates are dangerous in that the elbow of the user hits the projecting barrier at the side of the bracket which is in front of the passage. In addition, owing to the monolithic construction of the barrier directly connected with the driving shaft, the legally obligatory unlocking device is provided at the height of the driving shaft proper so that, when necessary, the gate cannot be pushed completely backwards because it is at a moment retained by the rear end of the windows provided in the side of the bracket which is in front of the passage. Thus, with the known gates, it is only possible to obtain an uncompletely opened passage which is really not sufficient for a rapid escape out of the establishment.

In addition, the gate according to the present invention is advantageous in that, owing to its original design, the barrier 4 cannot be forced or twisted and, accordingly, the electric motor is not likely to be overloaded contrarily to the known gates.

It is apparent that the gate described hereabove by way of illustration and without any limitation may be variously modified and that the shapes and the sizes of the individual parts may be selected in accordance with the local requirements. Thus, the brackets need not have a square cross-section, but they may also have, e.g., a cylindrical shape.

What I claim is:

1. A gate of the type generally used in supermarkets and similar establishments comprising:

a generally vertical rotatable axle;

vertically spaced supporting levers secured to and extending laterally of said axle, said levers having generally flat upper surfaces;

a pair of cylindrical rods secured to each upper surface in spaced parallel relation;

a U-shaped barrier having free ends and headed bolts pivotally connecting said free ends to said supporting levers to overlie said flat upper surfaces between said cylindrical rods; and spring means reacting against the heads of said bolts urging said free ends against said upper surfaces whereby said barrier may be rotated in either direction.

2. A gate as defined in claim 1 wherein said free ends are cylindrical and said rods are spaced apart a distance less than the diameter of said free ends.

* * * * *